US006041948A

United States Patent [19]

Filipak et al.

[11] Patent Number: 6,041,948

[45] Date of Patent: Mar. 28, 2000

[54] PRE-PACKED PRODUCT SHIPMENT AND DISPLAY DEVICE WITH SPRING-BIASED RESTOCKING FEED ARRANGEMENT

[75] Inventors: Edmund C. Filipak, Parma; Scott Tiedemann, Cleveland, both of Ohio

[73] Assignee: American Greetings Corporation, Cleveland, Ohio

[21] Appl. No.: 09/146,182

[22] Filed: Sep. 3, 1998

[51] Int. Cl.[7] ..... A47F 5/00

[52] U.S. Cl. ..... 211/85.1; 211/13.1; 211/59.3; 206/600; 312/71

[58] Field of Search ..... 211/59.3, 59.2, 211/51, 13.1, 85.1, 85.17; 312/71, 61; 206/600

[56] References Cited

U.S. PATENT DOCUMENTS

| | | | |
|---|---|---|---|
| 2,322,748 | 6/1943 | Shaw et al. | 211/85.17 |
| 2,499,089 | 2/1950 | Brill et al. . | |
| 3,333,708 | 8/1967 | LeBlanc et al. . | |
| 3,333,709 | 8/1967 | LeBlanc et al. . | |
| 3,891,092 | 6/1975 | Surrette et al. . | |
| 4,211,331 | 7/1980 | Salmon et al. . | |
| 4,336,886 | 6/1982 | Azoulay et al. | 211/85.3 |
| 4,614,272 | 9/1986 | Shelton et al. . | |
| 4,925,038 | 5/1990 | Gajewski | 211/59.2 |
| 5,115,920 | 5/1992 | Tipton et al. | 211/59.2 |
| 5,280,839 | 1/1994 | Crampton . | |
| 5,351,839 | 10/1994 | Beeler et al. | 211/59.3 |
| 5,449,076 | 9/1995 | Van Noord . | |
| 5,505,315 | 4/1996 | Carroll . | |
| 5,743,428 | 4/1998 | Rankin, VI . | |
| 5,794,782 | 8/1998 | Ascik | 211/85.1 X |

*Primary Examiner*—Robert W. Gibson, Jr.
*Attorney, Agent, or Firm*—Calfee, Halter & Griswold LLP

[57] ABSTRACT

A combined product shipment and display device has a plurality of pre-packed product support structures or cartons in a stacked arrangement within a display container structure which includes a base with sloped feeder ramps which advance successive product-carrying cartons in the stacks to openings in the display container, whereby product is neatly displayed at the exterior of the container. Successive cartons of the stack are advanced to the forward most position by spring urging means upon removal of emptied cartons so that the display maintains a freshly stocked and neat appearance.

6 Claims, 3 Drawing Sheets

PRE-PACKED PRODUCT SHIPMENT AND DISPLAY DEVICE WITH SPRING-BIASED RESTOCKING FEED ARRANGEMENT

FIELD OF THE INVENTION

The present invention pertains generally to retail product bulk packaging and display and, more particularly, to structures which serve as both bulk packages and store displays for products.

BACKGROUND OF THE INVENTION

Products are often displayed in stores in boxes or other display structures which also function as bulk packages of the products. Such structures stand on the floor, carry a sizable stock of product, and have graphic display panels which advertise the product. Shipping cartons which double as a retail display are advantageous in that unpacking and stocking of a separate display is avoided. Also, shipping/display boxes can be easily recycled or otherwise discarded when emptied, eliminating the expense of permanent displays.

One disadvantage of combined shipping and display packages is that, because they are not intended to be restocked, once the stock is partially or totally depleted, an entire new shipment is required to replace the display. Although some structures include stock storage compartments, this stock has to be separately placed in the exterior display panels. What is lacking is a combined shipping and display device which carries additional stock in pre-loaded displays, in order to increase the retail display lifespan of the display without sacrificing the efficiencies of this type device.

SUMMARY OF THE PRESENT INVENTION

The present invention provides a combined product shipping container and display device for shipment and display of products in a single structure. In accordance with one aspect of the invention, there is provided a retail product shipment and display device having a frame structure having at least one compartment configured to support a product carrying carton, the compartment having an opening through which a carton in the frame structure is accessible, the frame structure connected to a base which includes a sloped support surface on which a carton in the frame structure rests, the sloped support surface having a slope toward a compartment opening, and means connected to the frame for urging a carton within a compartment of the frame structure toward the compartment opening.

In accordance with another aspect of the invention, there is provided a product support and display device which includes a frame structure attached to a base, panels attached to the frame structure to form at least one compartment within the frame structure and an opening to the compartment, the frame structure attached to a base, the base having a sloped support surface located within the compartment, the sloped support surface oriented to slope downward toward the opening to the compartment, a product support structure adapted to fit within the compartment and rest upon the sloped support surface, and urging means adapted to urge the product support structure down the sloped support surface and toward the compartment opening.

These and other aspects and objects of the invention are herein described in particularized detail with reference to the accompanying Figures.

DETAILED DESCRIPTION OF PREFERRED AND ALTERNATE EMBODIMENTS

Figure 1:
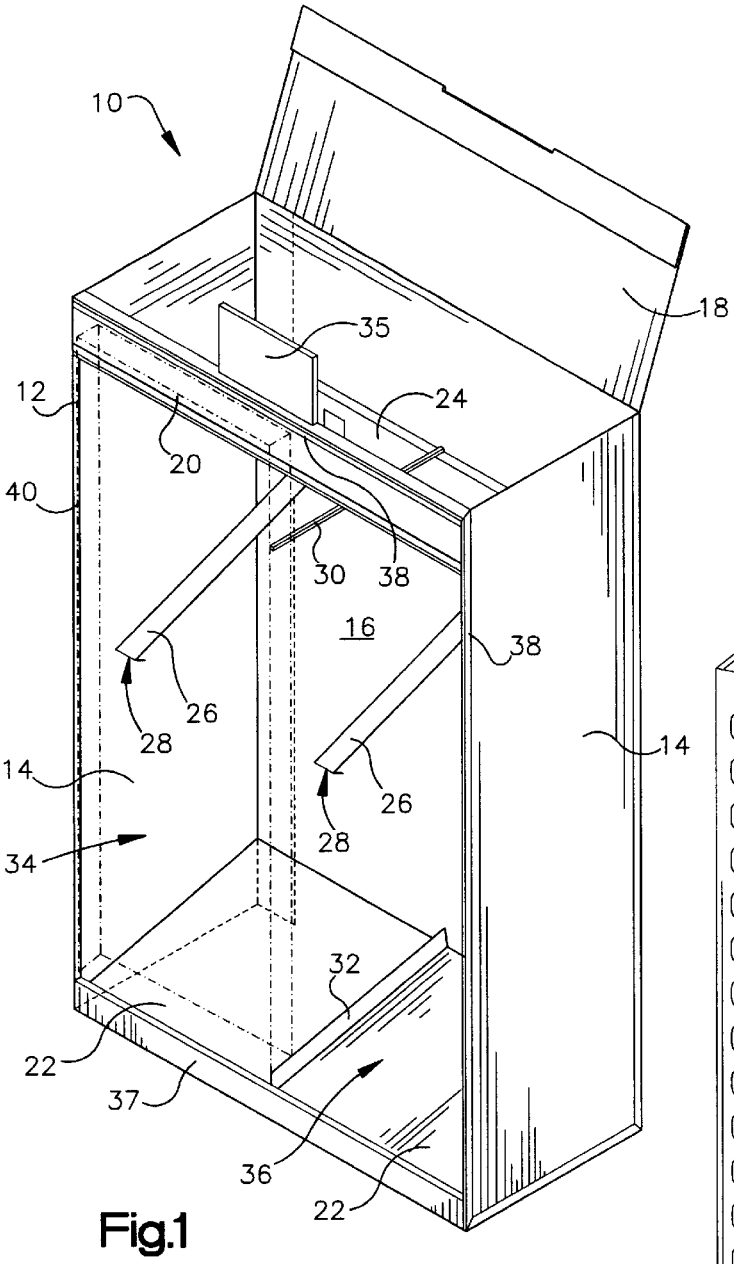
FIG. 1 is a perspective view of one embodiment of the retail product shipment and display device of the present invention.
Figure 2:
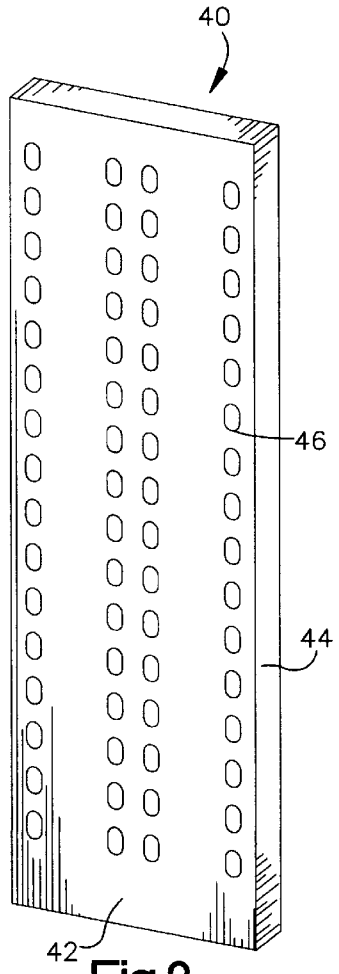
FIG. 2 is a perspective view of a merchandise support carton which fits within the display device of FIG. 1.

FIGS. 1 and 2 together illustrate a product shipment and display device 10 which includes a generally box-shaped frame structure 12 having side panels 14, a back panel 16, a hinged top panel 18 which also functions as a display header when in an upright or opened position as shown, a channeled cross piece 20 which extends between the side panels, and an angled floor or bottom panel or panels 22 which slope toward an opening in the frame structure which may be, for example, the front or side of the display. This basic structure is also referred to herein as a "container". A beam 24 extends across the back panel 16 between the side panels 14. Attached to the beam 24 are two spring steel pushers 26 which extend toward the open front of the display and which are angled slightly downward. A distal end 28 of the pushers 26 is thus positioned farthest from the back panel and biased toward the open front of the display. A divider 30 also extends from the beam 24 toward the front of the display, and is vertically aligned with a floor divider 32. The dividers 30 and 32 define separate compartments 34 and 36, which may be equal or unequal in width, within the display structure, with a pusher 26 approximately centrally located within each compartment. A mirror 35 may be attached to the cross piece 20 as a convenience in a retail display environment. J-channels 38 may be provided at the perimeters of the beam 24 and side panels 14 to hold display or decorative panels.

FIG. 2 illustrates one embodiment of a type of display carton 40, also referred to herein as a "product-carrying structure", which may be used in connection with the described display device 10. The display carton 40 is a generally rectangular structure with a front face 42, side walls 44, and a rear wall not shown. A pattern of apertures 46 is formed in the front face 42 for insertion of products or pieces of products such as the arms of spectacles or sunglasses. Although shown with a particular pattern, the carton can of course be alternately configured to receive and hold any type of product supportable by the carton, and/or solely by the front face 42 of the carton. The thickness of the cartons 40, as defined by the width of side walls 44, is dimensioned so that a plurality of cartons can be positioned front-to-back in a stacked arrangement within each of the compartments 34 and 36, with the front face 42 positioned within the opening in the frame structure to the compartments. The height of the cartons is somewhat greater than the height of the frontal opening in the frame to thereby retain the forward most carton within the frame structure. To this end, a lip 37 is provided across a bottom edge of the frame to contact a lower portion of the front face of the forward most carton. Preferably, a width dimension of the carton is less than a width of the frontal opening of the frame structure so that a carton can be removed through the opening by lifting it over lip 37.

As merchandise is depleted from the front face 42 of one of the cartons 40, the carton is removed from the display out the open top or out the opening. The next carton 40 directly behind the carton removed is urged to the forwardmost position by a pusher 26 or similar urging means so that merchandise is always displayed at the very front of the display device 10.

Figure 3:
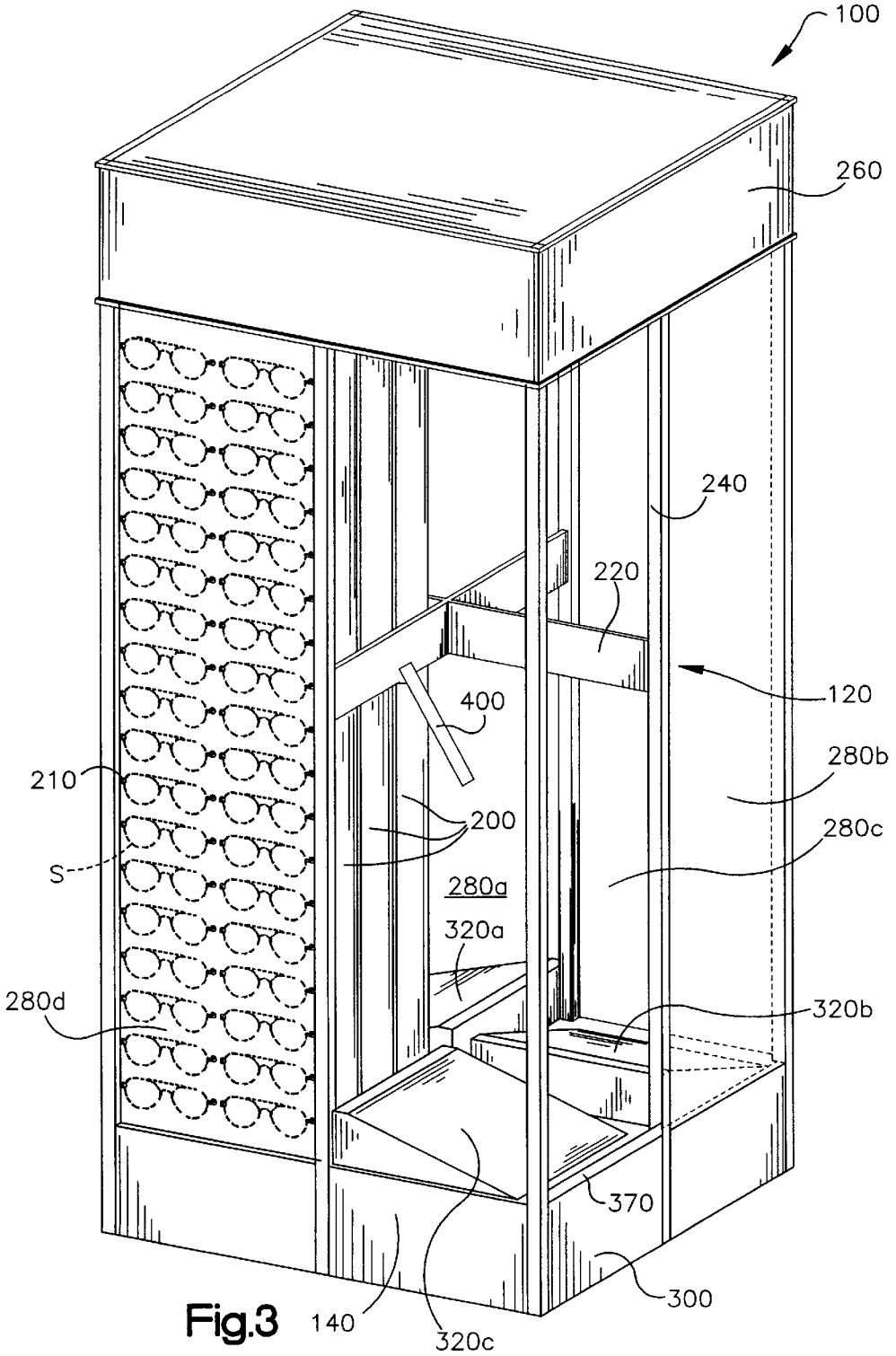
FIG. 3 is a perspective view of an alternate embodiment of a combined retail product shipment and display device constructed in accordance with the present invention.
Figure 4:
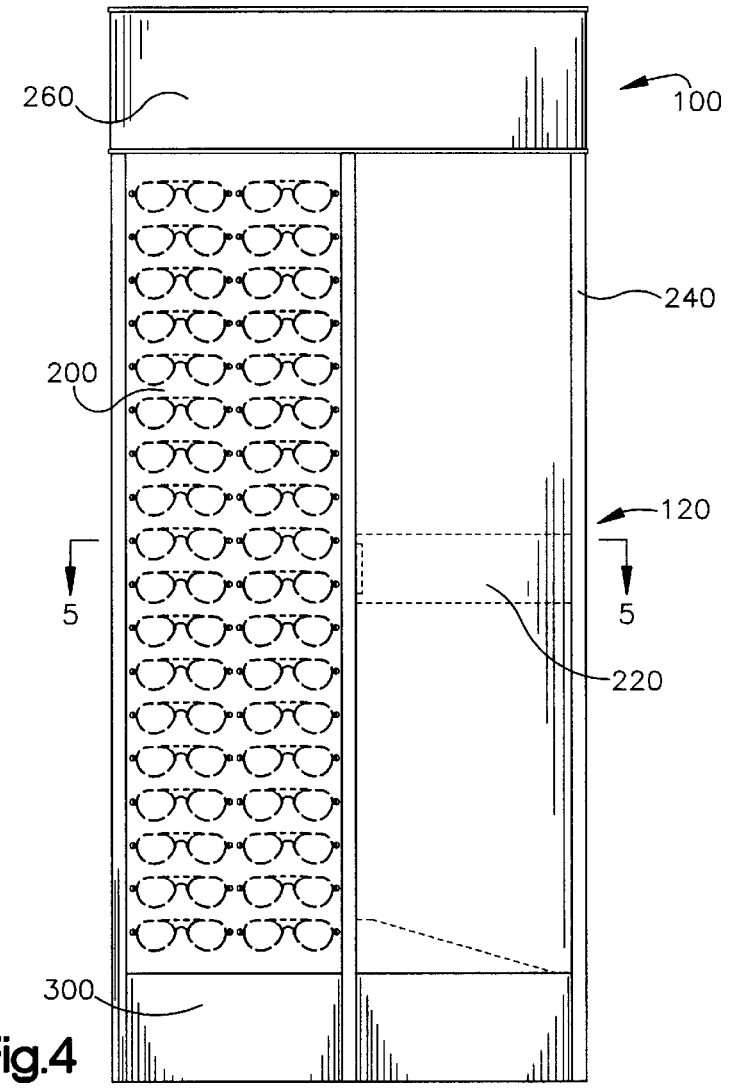
FIG. 4 is an elevation of the combined retail product shipment and display device of FIG. 3.
Figure 5:
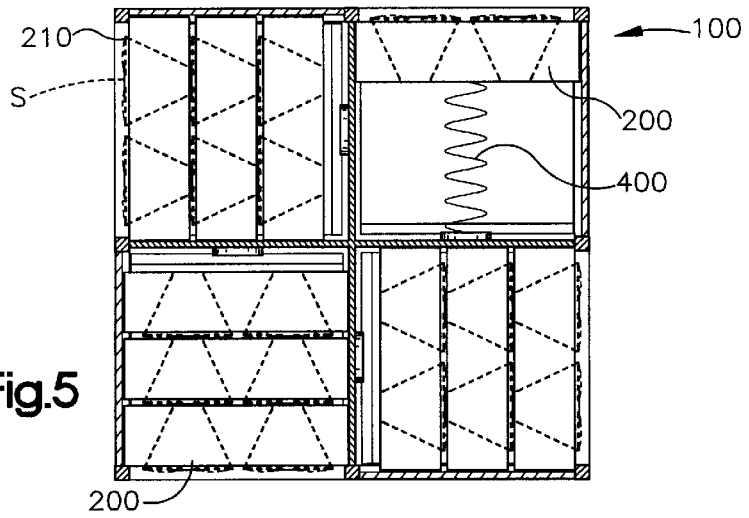
FIG. 5 is a top view of the combined retail product shipment and display device of FIG. 3.

FIGS. 3–5 illustrate an alternate embodiment of the invention which also provides a pre-packed product shipment and display device 100, which has stacked rows of product support and display panels 200, supported within a frame 120, and upon a contoured pallet 140. In this particular embodiment, the panels 200 are shown with apertures 210 configured to support spectacles S. It will be appreciated, however, that panels 200 may be alternately configured and otherwise adapted to support any type of product or products to be shipped and displayed in the described manner.

The frame 120 includes upper and lower internal joist members 220, which may intersect orthogonally or at other angles, connected to external stringers 240 which are generally vertically oriented. The stringers 240 extend upward from a four-sided base 300, also referred to herein as a pallet or contoured pallet. At a top end, the stringers 240 support a header 260, located generally above the upper joists 220. In this embodiment, the intersecting joists 220 divide the interior of the device into four quadrants 280*a*–280*d* which correspond to four contoured quadrants 320*a*–320*d* of base 300. Each base quadrant 320 is angled downward toward the exterior of the device, so that a lowest point of the base quadrant is located near the vertical plane in which the stringers are located. The slope of each base quadrant 320 is also oriented perpendicular to the slope of the adjacent base quadrants 320, so that the lowest point of each base quadrant is positioned at a different side of the four-sided base 300. A lip 370 extends across a bottom edge of each of the quadrants 320 to retain a lower portion of the forward most panel 200. As with the embodiment of FIG. 1, the panels 200 are preferably slightly narrower than the frontal opening in the frame 120 to allow removal through the opening by simply lifting the panel over the lip 370.

Each of the four quadrants 280*a*–280*d* have a depth dimension sufficient to accommodate a plurality of product support and display panels 200 arranged in upstanding rows. The panels 200 in this embodiment are generally rectangular, and with an individual depth dimension sufficient to accommodate a portion of product which engages with the panel, such as the arms of sunglasses, or any other appendage of any product. Alternatively, the panels 200 may be simply single-thickness material with through-holes for attachment of product. In the preferred form, however, the panels are configured as a generally elongate box out of, for example, corrugated cardboard, with a closed box end which rests upon the sloping surface of each base quadrant, and an uninterrupted rear surface. The upright stringers 240 form an exterior frame for each quadrant in which the forward-most panel 200 fits to display products. The top of each frame is bordered by the header 260.

In order to advance the forward-most panel 200 to the front of the respective quadrant and firmly against the frame, a spring 400 is mounted to extend within each quadrant down from the header 260 or joists 220, within each of the quadrants 280*a*–280*d*, and is biased toward the opening in the frame at the exterior of the display. As multiple panels 200 are loaded into a quadrant, the spring 400 contacts the rear wall of the innermost panel and, in conjunction with the gravity-assisted feed of the panels by the sloped quadrant bases 320, pushes the forward-most panel firmly against the frame. This produces a neat, structured appearance to the display and effectively conceals the presence of additional stock behind the forward-most panels.

As shown in FIG. 4, one half of each side of the display, adjacent to the exposed panel 200, may be occupied by a graphics panel which also functions to conceal the side edges of panels in the adjacent quadrant.

Although the invention has been described with reference to certain preferred and alternate embodiments, it is to be understood that the invention also includes modifications and variations which may occur to those of skill in the art. For example, and without limitation, other means for urging the cartons or product display panels to the openings of the frame structure may include coil type springs in various locations within the frame structure, other forms of bent metal or plastic springs such as bowed springs or generally elongate members having spring-like properties, or similar spring means attached directly to the cartons. The pushers may also be integrally formed with the cartons or frame structure.

What is claimed is:

1. A retail product shipment and display device comprising:

a frame structure having at least one compartment configured to support a product carrying carton, the compartment having an opening through which a product carrying carton in the frame structure is accessible, the frame structure connected to a base which includes a sloped support surface on which a product carrying carton in the frame structure rests, the sloped support surface having a slope toward a compartment opening, and means for urging a product carrying carton within a compartment of the frame structure toward the compartment opening, wherein the base includes at least two sloped support surfaces, and wherein at least two sloped support surfaces of the base are sloped in different directions.

2. A retail product shipment and display device comprising:

a frame structure having at least one compartment configured to support a product carrying carton, the compartment having an opening through which a product carrying carton in the frame structure is accessible, the frame structure connected to a base which includes a sloped support surface on which a product carrying carton in the frame structure rests, the sloped support surface having a slope toward a compartment opening, and means for urging a product carrying carton within a compartment of the frame structure toward the compartment opening, wherein the means for urging a product carrying carton within a compartment of the frame structure toward a compartment opening is connected to a product carrying carton.

3. A product support and display device comprising:

a frame structure attached to a base, panels attached to the frame structure to form at least one compartment within the frame structure and an opening to the compartment, the base having a sloped support surface located within the compartment, the sloped support surface oriented to slope downward toward the opening to the compartment, a product support structure adapted to fit within the compartment and rest upon the sloped support surface, and urging means adapted to urge the product support structure down the sloped support surface and toward the compartment opening, wherein the base comprises at least two sloped support surfaces which slope in different directions.

4. A product support and display device comprising:

a frame structure attached to a base, panels attached to the frame structure to form at least one compartment within the frame structure and an opening to the compartment, the base having a sloped support surface located within the compartment, the sloped support surface oriented to slope downward toward the opening to the compartment, a product support structure adapted to fit within the compartment and rest upon the sloped support surface, and urging means adapted to urge the product support structure down the sloped support surface and toward the compartment opening, wherein the product support structure is generally rectangular and comprises at least one wall with openings adapted to engage with a portion of a product.

5. A combined product shipment and display device comprising:

a container having a base with a flat bottom exterior surface upon which the container can be oriented in a generally upright position, an interior compartment to the container adapted to receive a plurality of product-carrying structures, and an opening in the container providing access to the interior compartment, the base having a sloped interior surface located within the interior compartment of the container and oriented to slope downward from a back of the compartment to the opening to the compartment, a plurality of product-carrying structures within the interior compartment of the container resting upon the sloped interior surface of the base, and a perimeter at least partially about the opening to the interior compartment of the container configured to prevent a product-carrying structure from passing through the opening.

6. A combined product shipment and display device comprising:

a container having a base with a flat bottom exterior surface upon which the container can be oriented in a generally upright position, an interior compartment to the container adapted to receive a plurality of product-carrying structures, and an opening in the container providing access to the interior compartment, the base having a sloped interior surface located within the interior compartment of the container and oriented to slope downward from a back of the compartment to the opening to the compartment, and a plurality of product-carrying structures within the interior compartment of the container resting upon the sloped interior surface of the base, wherein the container further comprises a top opening through which a product-carrying structure can be removed from the interior compartment of the container.

* * * * *